US005429542A

United States Patent [19]

Britt, Jr.

[11] Patent Number: 5,429,542

[45] Date of Patent: Jul. 4, 1995

[54] HELIUM-FILLED REMOTE-CONTROLLED SAUCER TOY

[76] Inventor: Harold D. Britt, Jr., 3625 S. Decatur #2065, Las Vegas, Nev. 89103

[21] Appl. No.: 235,475

[22] Filed: Apr. 29, 1994

[51] Int. Cl.[6] ..... A63H 27/127

[52] U.S. Cl. ..... 446/225; 446/37; 446/58

[58] Field of Search ..... 446/36, 37, 57, 58, 446/178, 179, 220, 225, 232; 244/26, 30, 31, 23 C, 27

[56] References Cited

U.S. PATENT DOCUMENTS

| | | | |
|---|---|---|---|
| 1,288,097 | 12/1918 | Martin | 446/220 |
| 1,370,178 | 3/1921 | Albert | 446/220 |
| 3,394,906 | 7/1968 | Rogers | 446/37 |
| 3,477,168 | 11/1969 | Trodgler | 446/37 |
| 3,518,788 | 7/1970 | Sides | 446/37 |
| 3,568,358 | 3/1971 | Bruce | 446/37 |
| 3,603,033 | 9/1971 | Mueller | 446/57 |
| 4,038,777 | 8/1977 | Schwartz | 446/225 |
| 4,065,873 | 1/1978 | Jones | 446/37 |
| 4,461,436 | 7/1984 | Messina | 446/37 |
| 4,729,750 | 3/1988 | Prusman | 446/225 |
| 4,891,029 | 1/1990 | Hutchinson | 446/58 |
| 4,931,028 | 6/1990 | Hawley | 446/225 |
| 4,946,415 | 8/1990 | Huang | 446/225 |
| 5,071,383 | 12/1991 | Kinoshita | 446/37 |
| 5,080,625 | 1/1992 | Huffhines | 446/225 |

*Primary Examiner*—Robert A. Hafer
*Assistant Examiner*—Jeffrey D. Carlson

[57] ABSTRACT

A helium-filled remote-controlled saucer toy comprising a hollow saucer having a central aperture disposed therethrough; a filling mechanism for allowing the saucer to be filled with helium gas for enabling the saucer to hover in air; a first fan having a fixed stator coupled within the aperture of the saucer, a rotatable rotor extended upwards therefrom, and fan blades coupled about the rotor for providing a propelling force for moving the saucer upwards or downwards when the rotor is rotated in one direction or in the opposite direction; a second fan having a fixed stator coupled within the aperture of the saucer, a rotatable rotor extended downwards therefrom, and fan blades coupled about the rotor for providing a propelling force for spinning the saucer clockwise or counter-clockwise when the rotor is rotated in one direction or in the opposite direction; a receiver mechanism adapted for receiving signals for controlling the direction of rotation of the fan blades; a power mechanism for energizing the fans and receiver mechanism; and a transmitter mechanism for transmitting signals to the receiver mechanism for controlling the fans.

1 Claim, 4 Drawing Sheets

HELIUM-FILLED REMOTE-CONTROLLED SAUCER TOY

BACKGROUND OF THE INVENTION

1. Field of the Invention

The present invention relates to a helium-filled remote-controlled saucer toy and more particularly pertains to hovering at a fixed location or moving from one location to another with a helium-filled remote-controlled saucer toy.

2. Description of the Prior Art

The use of saucer toys is known in the prior art. More specifically, saucer toys heretofore devised and utilized for the purpose of hovering at a fixed location or moving from one location to another are known to consist basically of familiar, expected and obvious structural configurations, notwithstanding the myriad of designs encompassed by the crowded prior art which have been developed for the fulfillment of countless objectives and requirements.

By way of example, U.S. Pat. No. DES. 326,873 to Chang discloses a toy novelty flying saucer.

U.S. Pat. No. 3,738,053 to Camarota discloses a flying saucer toy.

U.S. Pat. No. 4,065,873 to Jones discloses a flying saucer toy.

U.S. Pat. No. 4,135,325 to Lehman discloses an inflatable flying saucer toy.

Lastly, U.S. Pat. No. 4,228,616 to Wilson discloses a flying saucer toy.

While these devices fulfill their respective, particular objective and requirements, the aforementioned patents do not describe a helium-filled remote-controlled sauce toy that is adapted to hover, move upward or downward, or spin clockwise or counter-clockwise through the control of a remote: transmitter.

In this respect, the helium-filled remote-controlled saucer toy according to the present invention substantially departs from the conventional concepts and designs of the prior art, and in doing so provides an apparatus primarily developed for the purpose of hovering at a fixed location or moving from one location to another.

Therefore, it can be appreciated that there exists a continuing need for new and improved helium-filled remote-controlled saucer toy which can be used for hovering at a fixed location or moving from one location to another. In this regard, the present invention substantially fulfills this need.

SUMMARY OF THE INVENTION

In the view of the foregoing disadvantages inherent in the known types of saucer toys now present in the prior art, the present invention provides an improved helium-filled remote-controlled saucer toy. As such, the general purpose of the present invention, which will be described subsequently in greater detail, is to provide a new and improved, helium-filled remote-controlled saucer toy and method which has all the advantages of the prior art and none of the disadvantages.

To attain this, the present invention essentially comprises, in combination, a saucer. The saucer includes a funnel-shaped top portion having an open top end, a radially extended bottom end, and a hollow and tapered side wall extended therebetween. The saucer includes a funnel-shaped intermediate portion having a top end axially aligned and integrally coupled to the bottom end of the top portion at the radial extent thereof, a radially extended bottom surface having an aperture axially disposed thereon, and a hollow and tapered side wall extended between the top end and bottom surface with the bottom surface further having a hole disposed thereon and a grommet disposed within the hole adapted for receiving a nozzle for filling the saucer with helium gas. The saucer includes a-funnel-shaped bottom portion having a top end axially aligned and integrally coupled to the periphery of the aperture on the bottom surface of the intermediate portion, a radially retracted bottom end, and a hollow and tapered side wall extended therebetween. The saucer includes a circular wall extended across the inner extent of the intermediate portion near the bottom surface thereof to define a first chamber on one side of the wall and a second chamber on the other side of the wall with the wall having an axially aligned aperture disposed thereon. The saucer includes helium gas disposed within the portions of the saucer for allowing the saucer to hover in air.

A first fan is included and has a fixed stator coupled within the aperture of the wall of the saucer, a rotatable rotor extended upwards therefrom into the first chamber, and four fan blades coupled in quadrature about the rotor, radially extended outward therefrom, and angularly offset from the plane of rotation for providing a propelling force for moving the saucer downward when the rotor is rotated in one direction and moving the saucer upward when the rotor is rotated in the opposite direction. A hollow battery box is disposed within the second chamber and coupled to the stator of the first motor. A second fan is included and has a fixed stator disposed within the second chamber and coupled to the battery box, a rotatable rotor extended downwards from the stator and axially aligned with the rotor of the first motor, and two diametrically opposed fan blades coupled to the rotor and extended outward therefrom and perpendicularly offset from the plane of rotation for providing a propelling force for spinning the saucer clockwise when the rotor is rotated in one direction and spinning the saucer counter-clockwise when the rotor is rotated in the opposite direction. A receiver is coupled to the wall of the saucer and adapted for receiving signals for controlling the direction of rotor rotation of the first fan, whereby allowing the saucer to move upwards or downwards, and for controlling the direction of rotor rotation of the second fan, whereby allowing the saucer to spin clockwise or counter-clockwise. A battery is disposed within the battery box. Electrical power lines are coupled between the battery and the fans and the battery and receiver for energizing the fans and receiver. Lastly, a remote transmitter is included for transmitting signals to the receiver for controlling the fans and thereby allowing the upward movement, downward movement, clockwise spin, and counter-clockwise spin of the saucer to be regulated.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved helium-filled remote-controlled saucer toy which has all the advantages of the prior art saucer toys and none of the disadvantages.

It is another object of the present invention to provide a new and improved helium-filled remote-controlled saucer toy which may be easily and efficiently manufactured and marketed.

It is a further object of the present invention to provide a new and improved helium-filled remote-controlled saucer toy which is of durable and reliable construction.

An even further object of the present invention is to provide a new and improved helium-filled remote-controlled saucer toy which is susceptible of a low cost of manufacture with regard to both materials and labor, and which accordingly is then susceptible of low prices of sale to the consuming public, thereby making such a helium-filled remote-controlled saucer toy economically available to the buying public.

Still yet another object of the present invention is to provide a new and improved helium-filled remote-controlled saucer toy which provides in the apparatuses and methods of the prior art some of the advantages thereof, while simultaneously overcoming some of the disadvantages normally associated therewith.

Even still another object of the present invention is to provide a new and improved helium-filled remote-controlled saucer toy for hovering at a fixed location or moving from one location to another.

Lastly, it is an object of the present invention to provide a new and improved helium-filled remote-controlled saucer toy comprising a hollow saucer having a central aperture disposed therethrough; filling means for allowing the saucer to be filled with helium gas for enabling the saucer to hover in air; a first fan having a fixed stator coupled within the aperture of the saucer, a rotatable rotor extended upwards therefrom, and fan blades coupled about the rotor for providing a propelling force for moving the saucer downward when the rotor is rotated in one direction and moving the saucer upward when the rotor is rotated in the opposite direction; a second fan having a fixed stator coupled within the aperture of the saucer, a rotatable rotor extended downwards therefrom, and fan blades coupled about the rotor for providing a propelling force for spinning the saucer clockwise when the rotor is rotated in one direction and spinning the saucer counter-clockwise when the rotor is rotated in the opposite direction; receiver means adapted for receiving signals for controlling the direction of rotation of the fan blades; power means for energizing the fans and receiver means; and transmitter means for transmitting signals to the receiver means for controlling the fans and thereby allowing the upward movement, downward movement, clockwise spin, and counter-clockwise spin of the saucer to be regulated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
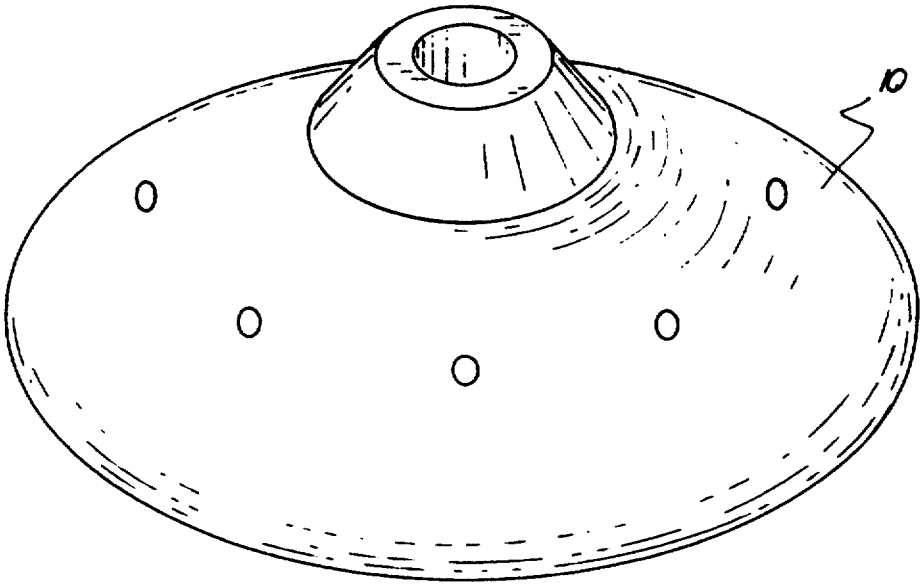
FIG. 1 is a perspective view of the preferred embodiment of the helium-filled remote-controlled saucer toy constructed in accordance with the principles of the present invention.
Figure 2:
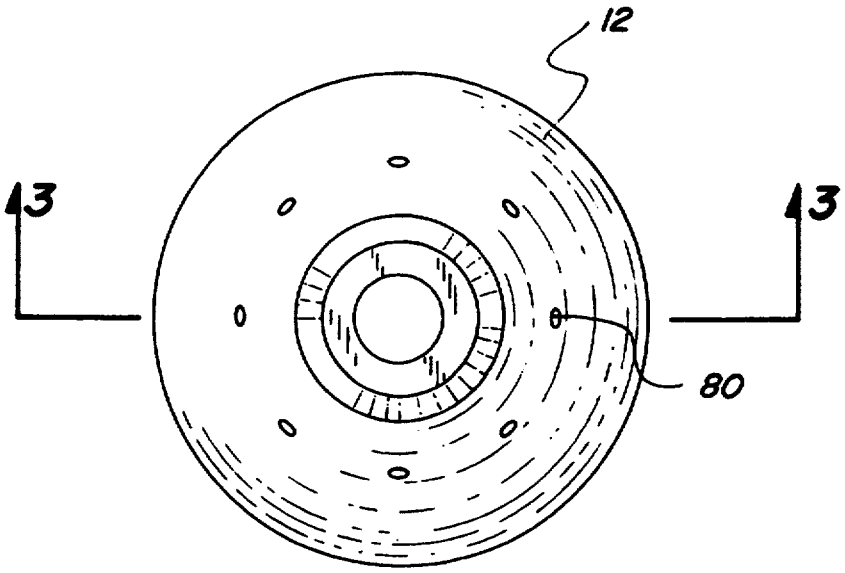
FIG. 2 is a plan view of the present invention depicted in FIG. 1.
Figure 3:
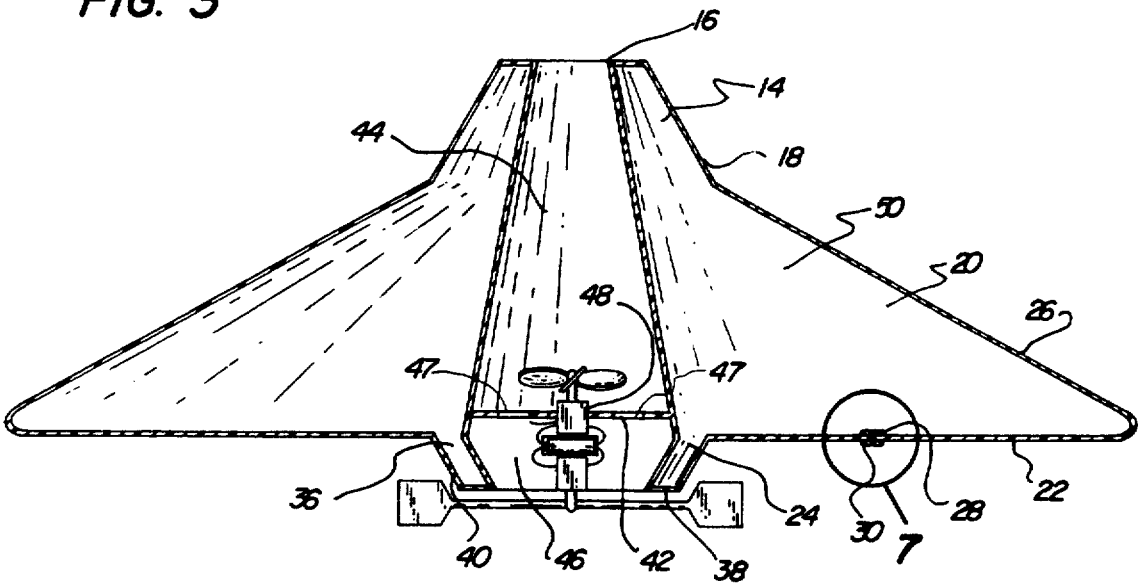
FIG. 3 is a cross-sectional view of the present invention taken along the line 3—3 of FIG. 2.
Figure 4:
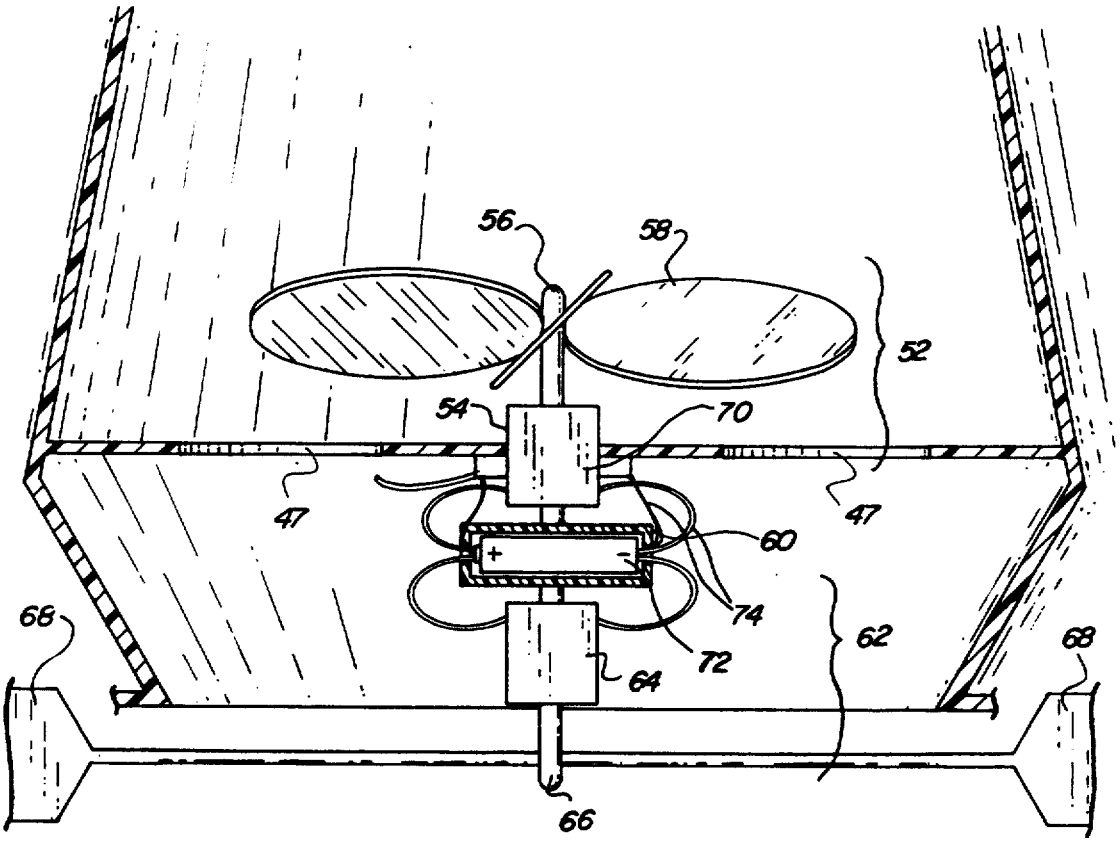
FIG. 4 is an enlarged view of the components disposed within the first and second chambers of the saucer.
Figure 6:
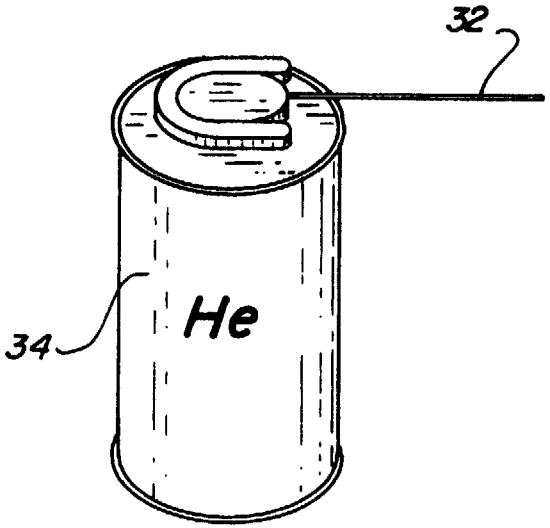
FIG. 6 is a perspective view of a helium containment and pumping device used to fill the saucer for floating in air.
Figure 5:
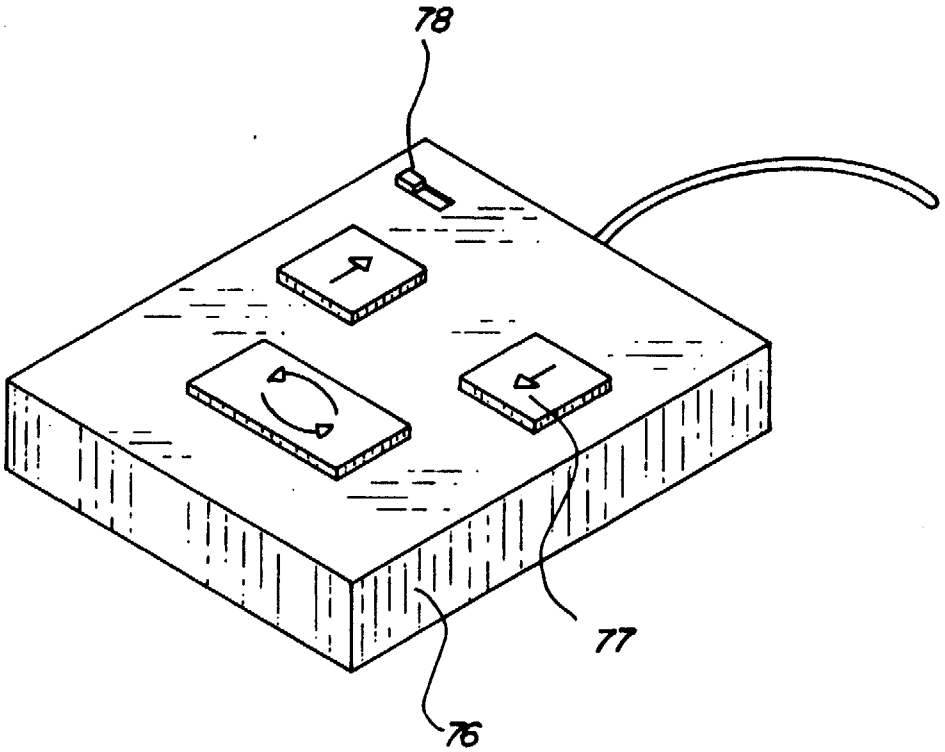
FIG. 5 is a perspective view of the transmitter used to remotely control the saucer toy.
Figure 8:
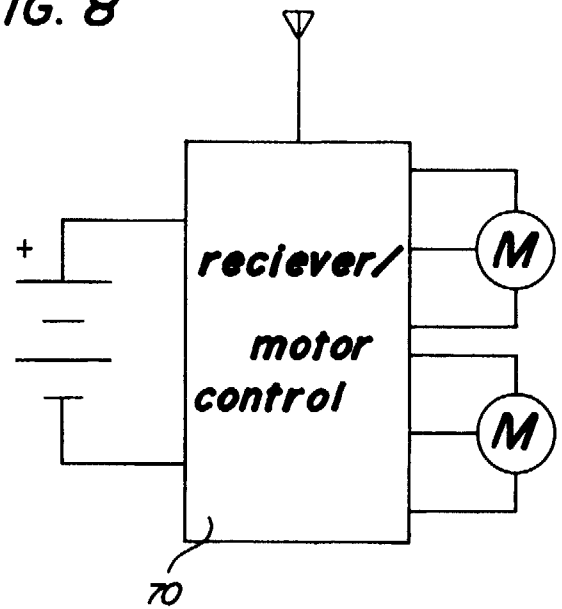
FIG. 8 is a schematic view of the receiver used to control motor operations within the present invention for allowing upward and downward movement and clockwise and counter-clockwise spinning.
Figure 9:
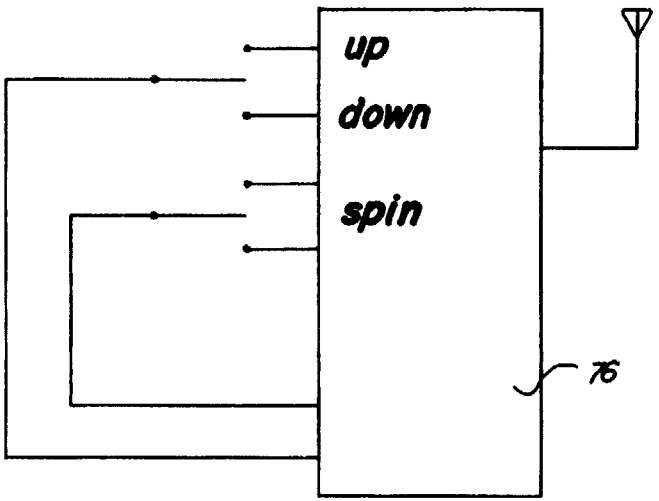
FIG. 9 is a schematic view of the transmitter used to transmit control signals for controlling the upward and downward movement of the saucer and for controlling the clockwise or counter-clockwise spin of the saucer.
Figure 7:
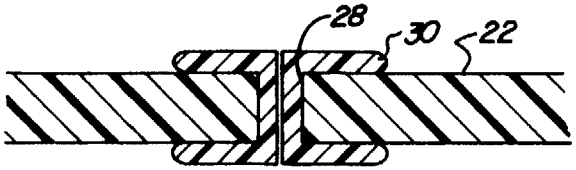
FIG. 7 is an enlarged view of the grommet in FIG. 3 with the grommet being utilized for allowing the saucer to be filled with helium.

With reference now to the drawings, and in particular, to FIG. 1 thereof, the preferred embodiment of the new and improved helium-filled remote-controlled saucer toy embodying the principles and concepts of the present invention and generally designated by the reference number 10 will be described.

Specifically, the present invention includes eight major components. The major components are the saucer, first fan, battery box, second fan, receiver, battery, power lines, and transmitter. These components are interrelated to provide the intended function.

More specifically, it will be noted in the various Figures that the first major component is the saucer 12. The saucer includes five subcomponents. The subcomponents are the top portion, intermediate portion, bottom portion, wall, and helium gas. These subcomponents are interrelated to provide the intended function.

The first subcomponent of the saucer is the top portion 14. The top portion is funnel-shaped. It has an opened top end 16 and a radially extended bottom end. A tapered side wall 18 is extended between the top end and the bottom end.

The second subcomponent of the saucer is the intermediate portion 20. The intermediate portion is funnel-shaped. It has a top end axially aligned and integrally coupled to the bottom end of the top portion 14 at the radial extent thereof. The intermediate portion has a radially extended bottom surface 22. The bottom surface has an central aperture 24 axially disposed thereon. A tapered side wall 26 is extended between the top end and the bottom surface. The bottom surface further includes a hole 28 disposed thereon. A grommet 30 is disposed within the hole. The grommet is adapted for receiving a nozzle 32 of a gas pumping device 34 for filling the saucer with a gas whose density is lighter than air.

The third subcomponent of the saucer is the bottom portion 36. The bottom portion is funnel-shaped. It has a top end axially aligned and integrally coupled to the periphery of the aperture 24 on the bottom surface of the intermediate portion. The bottom portion also has a radially retracted open bottom end 38. The bottom end is in communication with the open top end of the top portion through the intermediate portion. A tapered side wall 40 is extended between the top end and bottom end.

The fourth subcomponent of the saucer is the partition wall 42. The partition wall is essentially circular in structure. It is extended across the inner extent of the intermediate portion 20 near the bottom surface 22 thereof. A first chamber 44 is defined on one side of the partition wall adjacent to the top portion 14. A second chamber 46 is defined on the other side of the partition wall adjacent to the bottom portion 36. The wall further includes two through holes 47 and an axially aligned aperture 48 disposed therebetween.

The fifth subcomponent of the saucer is the helium gas 50. The helium gas is disposed within, the portions 14, 20, 36 of the saucer. The helium gas allows the saucer to hover in air. Other gases whose density is lighter than air may also be utilized.

The second major component is the first fan 52. The first fan has a fixed stator 54 coupled within the aperture 48 of the partition wall 42 of the saucer. A rotatable rotor 56 is extended upwards from the stator into the first chamber 44. Four fan blades 58 are coupled in quadrature about the rotor. The fan blades are radially extended outward from the rotor and angularly offset from the plane of rotation thereof. The blades provide a propelling force for moving the saucer downward when the rotor is rotated in one direction. The blades also provide a propelling force for moving the saucer upward when the rotor is rotated in the opposite direction.

The third major component is the battery box 60. The battery box is rigid in structure. It is disposed within the second chamber 46. It is coupled to the stator 54 of the first motor. The battery box is adapted for holding a battery therein to serve as a primary power source for the saucer.

The fourth major component is the second fan 62. The second fan has a fixed stator 64 disposed within the second chamber 46 and coupled to the battery box 60. The second fan includes a rotatable rotor 66 extended downwards from the stator. The rotor is axially aligned with the rotor 56 of the first motor. A second fan has two diametrically opposed fan blades 68 coupled to the rotor. The fan blades are extended outward from the rotor and perpendicularly offset from the plane of rotation thereof. The fan blades provide a propelling force for spinning the saucer clockwise when the rotor is rotated in one direction. The fan blades also provide a propelling force for spinning the saucer counter-clockwise when the rotor is rotated in the opposite direction.

The fifth major component is the receiver 70. The receiver is coupled to the wall 42 of the saucer. The receiver is adapted for receiving signals for controlling the direction of rotor rotation of the first fan, whereby allowing the saucer to move upwards or downwards. The receiver is also adapted for receiving signals for controlling the direction of rotor rotation of the second fan 62, whereby allowing the saucer to spin clockwise or counter-clockwise. The receiver includes an antenna extended therefrom into the second compartment 46 for capturing the signals. The circuitry of the receiver is conventional is design. It is fabricated from commercially available electronic circuit components or subsystems.

The sixth major component is the battery 72. The battery is disposed within the battery box. The battery is used for supplying power to the fans and receiver. The battery is conventional in design and commercially available.

The seventh major component is the power lines 74. The power lines are adapted for transferring electrical energy therethrough from the battery 72. The power lines are coupled between the battery and the fans 52, 62. Power lines are also coupled between the battery and the receiver 70. The power lines transfer electrical energy for activating the fans and receiver. The power lines are constructed from conventional and commercially available sheathed metal wire.

The eighth major component is the transmitter 76. The transmitter is adapted to be operated in a remote location. The transmitter transmits signals to the receiver for controlling the fans. By controlling the fans, a user is able to control the upward movement, downward movement, clockwise spin, and counter-clockwise spin of the saucer. The transmitter includes a plurality of keys 77 adapted to be pressed by a user for activating the controlling functions. The transmitter is activated and de-activated by a switch 78 thereon. The transmitter includes an antenna for transmitting the signals through the air. The circuitry of the transmitter is conventional is design. It is fabricated from commercially available electronic circuit components or subsystems. Power is provided by a conventional and commercially available battery.

To compliment the appearance of the saucer, different types of surface ornamentation 80 may be attached thereto. For example, surface ornamentation simulating lights, windows, or doors may be attached around the intermediate portion 20 of the saucer. This surface ornamentation is added to give the saucer a more realistic look. Other types of decorative surface ornamentation could be placed on the saucer to enhance its appearance when spinning.

In the preferred embodiment, the present invention is made of lightweight plastic in the classic form of a flying saucer with a conically shaped upper section and a smaller flat bottom which simulates the landing pad. The top of the cone is truncated and shaded in a darker color to simulate the exit/entrance port, and a row of painted "lights" traverse its midsection.

Two miniature fans complete the assembly, and these are mounted near the landing pad section. The blades of one of these fans are horizontally oriented and serve to raise the saucer while the blades of the other fanfare in a perpendicular to spin the flying saucer. The combined weight of the fans and the saucer material counteract the buoyant effect of the pressurized helium so that the saucer will hover above the ground but not rise to a point where it is out of reach of a user. The helium required to inflate the present invention is provided along with the saucer itself and may also be purchased separately. Hence, it can be seen that by controlling the speed of the two fans, the saucer can be manipulated to ascend, descend and spin.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A helium-filled remote-controlled saucer toy comprising, in combination:

a saucer formed of a lightweight plastic further comprising:

a funnel-shaped top portion having an open top end, a radially extended bottom end, and a tapered side wall extended therebetween;

a funnel-shaped intermediate portion having a top end axially aligned and integral with the bottom end of the top portion at the radial extent thereof, a radially extended bottom surface having a central aperture axially disposed thereon, and a tapered side wall extended between the top end of the intermediate portion and the bottom surface and with the bottom surface further having a hole disposed thereon and a grommet disposed within the hole adapted for receiving a nozzle for filling the saucer with helium gas;

a funnel-shaped bottom portion having a radially extended top end axially aligned and integral with the periphery of the central aperture on the bottom surface of the intermediate portion, an open bottom end in communication with the open top end of the top portion through the intermediate portion, and a tapered side wall extended therebetween;

a circular partition wall extended across the intermediate portion near the bottom surface to define a first chamber on one side thereof and a second chamber on the other side thereof and with the partition wall further having two through holes with an axially aligned aperture disposed therebetween; and helium gas disposed within the portions of the saucer for enabling the saucer to hover in air;

a first fan having a fixed stator coupled within the aperture of the partition wall of the saucer, a rotatable rotor extended upwards therefrom into the first chamber, and four fan blades coupled in quadrature about the rotor, radially extended outwards therefrom, and angularly offset from the plane of rotation for providing a propelling force for moving the saucer downward when the rotor is rotated in one direction and moving the saucer upward when the rotor is rotated in the opposite direction;

a hollow battery box disposed within the second chamber and coupled to the stator of the first motor;

a second fan having a fixed stator disposed within the second chamber and coupled to the battery box, a rotatable rotor extended downwards from the stator and axially aligned with the rotor of the first motor, and two diametrically opposed fan blades coupled to the rotor and extended outwards therefrom and perpendicularly offset from the plane of rotation for providing a propelling force for spinning the saucer clockwise when the rotor is rotated in one direction and spinning the saucer counter-clockwise when the rotor is rotated in the opposite direction;

a receiver coupled to the partition wall of the saucer and adapted for receiving signals for controlling the direction of rotor rotation of the first fan and controlling the direction of rotor rotation of the second fan;

a battery disposed within the battery box;

electrical power lines coupled between the battery and the fans and the battery and receiver for energizing the fans and receiver; and a remote transmitter for transmitting signals to the receiver for controlling the fans and thereby allowing the upward movement, downward movement, clockwise spin, and counter-clockwise spin of the saucer to be regulated.

* * * * *